US007404215B2

(12) United States Patent
Allen

(10) Patent No.: US 7,404,215 B2
(45) Date of Patent: Jul. 29, 2008

(54) DETACHABLE PROTECTIVE CUFF GUARD FOR PANTS

(76) Inventor: Delroy Allen, 10 Post Oak La., Unit 5, Natick, MA (US) 01760

( * ) Notice: Subject to any disclaimer, the term of this patent is extended or adjusted under 35 U.S.C. 154(b) by 0 days.

(21) Appl. No.: 11/493,374

(22) Filed: Jul. 26, 2006

(65) Prior Publication Data

US 2007/0028367 A1 Feb. 8, 2007

Related U.S. Application Data

(60) Provisional application No. 60/702,176, filed on Jul. 26, 2005.

(51) Int. Cl.
*A41D 1/06* (2006.01)
*A41F 17/02* (2006.01)

(52) U.S. Cl. ..... 2/232; 2/231; 24/72.1

(58) Field of Classification Search ..... 2/230–232, 2/60, 269, 244, 132; 24/41.1, 303, 72.1; 36/70 R See application file for complete search history.

(56) References Cited

U.S. PATENT DOCUMENTS

| | | | | | |
|---|---|---|---|---|---|
| 176,292 | A | * | 4/1876 | Gardner | 2/232 |
| 257,026 | A | * | 4/1882 | Langan | 2/232 |
| 261,029 | A | * | 7/1882 | Olney | 2/232 |
| 485,807 | A | * | 11/1892 | Aaronson | 2/232 |
| 898,200 | A | * | 9/1908 | Elzas | 2/232 |
| 1,023,864 | A | | 4/1912 | Miller | |
| 1,211,472 | A | * | 1/1917 | Marcelli | 2/232 |
| 1,448,455 | A | | 3/1923 | Leander | |
| 1,992,235 | A | * | 2/1935 | Irving | 2/232 |
| 2,583,861 | A | * | 1/1952 | Lewallen | 2/232 |
| 2,677,829 | A | * | 5/1954 | Rothstein et al. | 2/232 |
| 3,380,075 | A | | 4/1968 | Marthinsson | |
| 3,722,001 | A | | 3/1973 | Bailey | |
| 3,741,376 | A | * | 6/1973 | Brown et al. | 206/5 |
| 4,190,903 | A | * | 3/1980 | Kinsella | 2/60 |
| 4,249,267 | A | * | 2/1981 | Voss | 2/69 |
| 4,255,837 | A | * | 3/1981 | Holtz | 24/303 |
| 4,896,379 | A | | 1/1990 | Kape | |
| 5,283,966 | A | * | 2/1994 | Rader et al. | 40/1.5 |
| 5,604,960 | A | * | 2/1997 | Good | 24/303 |

(Continued)

OTHER PUBLICATIONS http://www.wisegeek.com/what-is-neoprene-rubber.htm; "What is Neoprene Rubber"; p. 1-2; reference on p. 1, para. 1.*

(Continued)

*Primary Examiner*—Gary L. Welch
*Assistant Examiner*—Jena A Sold
(74) *Attorney, Agent, or Firm*—Lowrie, Lando & Anastasi, LLP

(57) ABSTRACT

Disclosed herein is a protective cuff guard for protecting the hem of a pants leg. In exemplary embodiments the cuff guard comprises a body comprising at least one layer of durable material such as neoprene or nylon; a first fastener element and a second fastener element, disposed such that when the body is folded around the hem of the pants leg, the first fastener element engages the second fastener element, detachably affixing the body to the pants leg. In further embodiments at least some of the fastener elements are magnets. In further embodiments the cuff guard may further comprise a decorative device affixed to the body of the cuff guard.

12 Claims, 5 Drawing Sheets

U.S. PATENT DOCUMENTS 5,682,653 A * 11/1997 Berglof et al. ..... 24/303
5,722,126 A * 3/1998 Reiter ..... 24/303
5,740,557 A 4/1998 Reid et al.
6,286,150 B1 * 9/2001 Miller et al. ..... 2/232
6,484,322 B2 * 11/2002 Christian ..... 2/209.13
6,829,847 B2 * 12/2004 O'Shea et al. ..... 36/70 R
6,836,899 B1 * 1/2005 Glasmire ..... 2/52
6,865,751 B1 3/2005 Brasher
6,954,968 B1 * 10/2005 Sitbon ..... 24/303
7,086,092 B1 * 8/2006 Cruz ..... 2/132
2003/0029006 A1 * 2/2003 Pelt et al. ..... 24/303
2003/0154576 A1 * 8/2003 Mirharooni ..... 24/41.1
2004/0049948 A1 * 3/2004 Q'Shea et al. ..... 36/70 R
2005/0144704 A1 * 7/2005 Vitallo ..... 2/247
2006/0032026 A1 * 2/2006 Schoening et al. ..... 24/66.1
2006/0174389 A1 * 8/2006 Engel ..... 2/46

OTHER PUBLICATIONS

Search Report and Written Opinion for PCT/US06/29130.

* cited by examiner

DETACHABLE PROTECTIVE CUFF GUARD FOR PANTS

CROSS-REFERENCE TO RELATED APPLICATIONS

This application claims priority to U.S. Provisional Application Ser. No. 60/702,176, entitled Pant Cuff Guards, filed Jul. 26, 2005.

BACKGROUND

1. Field of the Invention

This disclosure relates to the field of garments designed to protect a portion of the clothes of the wearer from tears, wear, dirt, or stains. More particularly, this disclosure relates to a protective cuff guard that may be detachably affixed to the hem of the pants of the wearer, thereby protecting the hem of the pants.

2. Discussion of the Related Art

Detachable pant cuff attachments designed to allow easy alteration of the length of the pants leg are known in the art. For example, U.S. Pat. No. 3,722,001 describes a variable length trousers construction in which a separate cuff portion is detachably secured to the bottom of the pants leg, allowing adjustment of the length as desired by varying the length of a folded portion of the cuff. Similarly U.S. Pat. No. 4,896,379 describes a cuff arrangement, attached to the pants leg by Velcro pads, buttons, or hooks and eyes, having a portion that may be lowered over the pants hem to lengthen the pants leg. U.S. Pat. No. 2,677,829 describes a detachable cuff, attached to the wearer's pants by snaps, designed to save the wearer the difficulty of folding a neat, uniform cuff in the bottom of the pants leg itself.

Though such detachable-cuff systems may be used to mask wear-and-tear that has occurred at the hem of a pair of pants, they are not designed to protect the pants from wear-and-tear damage in the first instance. Moreover, the attachment systems they disclose require some modification to the pants themselves, such as the attachment of Velcro pads, the addition of buttons or the cutting of button-holes, or the insertion of snaps.

Casual-style pants are often worn long, sometimes down to the bottom of the wearer's shoes. They are therefore susceptible to damage or soiling from contact with the ground at the wearer's feet. In wet weather, the dyes from casual pants can run, staining light-colored shoes or sneakers. Even for dress pants that are not often worn as long are vulnerable to dirt and moisture during inclement weather. Therefore there is a need in the art for a protective cuff guard that can protect the pants from wear-and-tear, rain or mud, dirt, or staining, which is also attachable and removable at the desire of the wearer, quickly and with little effort.

SUMMARY OF THE INVENTION

We have developed a detachable protective cuff guard that addresses the above need. Using the detachable protective cuff guards described herein, wearers of casual pants in the long, over-the-shoes style can easily protect the hems from fraying and soiling. Wearers of dress pants can protect their hems from mud and moisture while outside in inclement weather, and quickly remove the protective cuff guard upon arrival at the office or other destination. Embodiments of the detachable cuffs described herein are made from a durable protective material such as neoprene, nylon, weather-treated canvas, or other such durable water- and/or stain-resistant material. In certain embodiments they feature magnetic fasteners that allow them to detachably attach to the hem of the pants without the need to modify the pants themselves.

Embodiments of the present invention are directed to a protective cuff guard for protecting the hem of a pants leg comprising a body comprising at least one layer of durable material, and a first fastener element and a second fastener element, disposed such that when the body is folded around the hem of the pants leg, the first fastener element engages the second fastener element, detachably affixing the body to the pants leg.

In further embodiments, at least one of the first fastener element and the second fastener element is a magnet.

In further embodiments, the durable material is nylon or neoprene.

In further embodiments, a decorative device may be affixed to the body of the cuff guard.

In further embodiments, the first fastener element or the second fastener element or both are affixed to a surface of the body.

In still further embodiments, the body of the cuff guard comprises at least two layers of durable material, and the first fastener element or the second fastener element or both are disposed between two of the layers of durable material.

In still further embodiments, the at least two layers of durable material are secured together with glue.

In still further embodiments, the at least two layers of durable material are secured together with stitching.

In still further embodiments, a protective cuff guard for protecting the hem of a pants leg comprises a body comprising at least one layer of durable material; and at least one top fastener element and at least one bottom fastener element, disposed such that when the body is folded around the hem of the pants leg, each of the at least one top fastener elements engages one of the at least one bottom fastener elements, detachably affixing the body to the pants leg.

In further embodiments, the top fastener elements or the bottom fastener elements or both are magnets.

In further embodiments, the number of top fastener elements is the same as the number of bottom fastener elements.

In further embodiments, the number of top fastener elements is different from the number of bottom fastener elements.

In further embodiments, the top fastener elements or the bottom fastener elements or both are affixed to a surface of the body.

In further embodiments, the body comprises at least two layers of durable material, and the top fastener elements or the bottom fastener elements or both are disposed between two of the layers of durable material.

In some embodiments, a system for protecting the hem of a pants leg comprises a protective cuff guard comprising a body comprising at least one layer of durable material and at least one clip, wherein the at least one clip is so configured that when the body is folded around the hem of the pants leg, and the at least one clip is placed around the body at an angle approximately perpendicular to the lower edge of the hem of the pants leg, the at least one clip operates to detachably affix the body to the pants leg.

BRIEF DESCRIPTION OF THE DRAWINGS

The protective cuff guards described herein will be understood with reference to the accompanying drawings. These drawings are not intended to be drawn to scale. In the drawings, each identical or nearly identical component that is illustrated in various figures is represented by a like numeral.

For purposes of clarity, not every component may be labeled in every drawing. In the drawings.

DETAILED DESCRIPTION

Figure 1A:
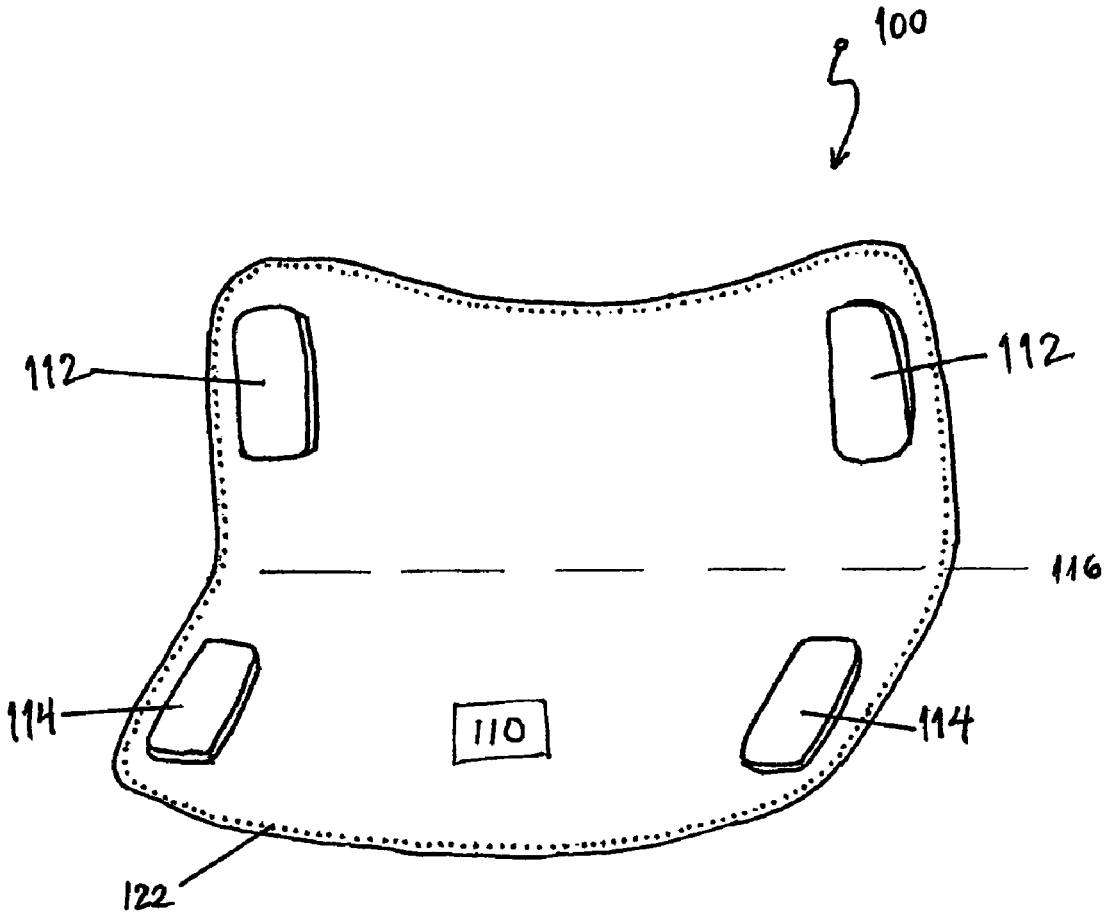
FIG. 1A illustrates an exemplary embodiment of a detachable protective cuff guard.

Various embodiments and aspects thereof will now be described in more detail with reference to the accompanying figures. It is to be appreciated that this invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

FIG. 1 illustrates an exemplary embodiment of a detachable protective cuff guard 100. The detachable protective cuff guard 100 comprises a piece of durable protective material that makes up the body 110 of the cuff. The durable material may be neoprene, nylon (such as rib-stock nylon), canvas or denim (which may be weather-treated), or other similar durable material. Any material that is sufficiently flexible that it may bend to conform to the cylindrical shape of the pants hem, yet sufficiently durable to survive repeated wearing without fraying or tearing, is suitable for us in the body 110 of the cuff. Materials such as neoprene, nylon, or canvas have an advantage of being available in a variety of colors, to suit the aesthetic preferences of the user. The body 110 of the cuff may be formed from a single piece of the durable material, or from several pieces stitched or otherwise bonded together. In an exemplary embodiment, the body 110 of the cuff guard 100 is formed of two or more layers of durable material, stitched together with stitches 122 disposed near the edges of the body 110 of the cuff guard 100. Alternatively, where the body 110 is formed of two or more layers of durable material, the layers may be glued, epoxied, welded, or otherwise bonded together.

An exemplary detachable protective cuff guard 100 also includes at least one fastener comprising fastener elements 112 and 114. In an exemplary embodiment, fastener elements 112 and 114 are magnets, so that when the detachable protective cuff guard 100 is folded upon itself around the hem of a pants leg (as described further below) the fastener elements 112 and 114 engage magnetically through the pants leg to secure the detachable protective cuff guard 100 in place at the hem of the pants leg. In another exemplary embodiment one of the fastener elements 112 or 114 is a magnet, while the other is a magnetic material such as a thin steel shim. In such an embodiment the fastener elements will also engage magnetically through the pants leg to secure the detachable protective cuff guard 100 during use.

The fastener elements 112 and 114 may be affixed to the body 110 of the detachable protective cuff guard 100 by a variety of means. In an exemplary embodiment the fastener elements 112 and 114 are glued or epoxied to the surface of the body 110 of the detachable protective cuff guard 100. In embodiments in which the body 110 of the detachable protective cuff guard 100 is formed of two or more layers of durable material stitched or otherwise affixed together, the fastener elements 112 and 114 may be sandwiched between two of the layers. In such embodiments, the fastener elements 112 and 114 may be glued or epoxied to one layer (or to both one layer and an adjacent layer) before the layer is affixed to its adjacent layer. In an embodiment in which adjacent layers of durable material are bonded together by pressing or heating, fastener elements 112 and 114 sandwiched in between two layers may be held in place by the pressure of the surrounding layers. In embodiments in which the fastener elements 112 and 114 are sandwiched between adjacent layers of durable material, the fastener elements 112 and 114 may engage magnetically through the layers of durable material and through the pants leg to secure the detachable protective cuff guard 100 during use.

In still other alternative embodiments, a combination of means may be used to affix the fastener elements 112 and 114 to the body 110 of the detachable protective cuff guard 100. For example, one fastener element 112 may be a magnet glued to the surface of the body 110 of the detachable protective cuff guard 100, while the other fastener element 114 may be a strip of magnetic material glued or otherwise embedded between two layers of durable material.

Figure 1B:
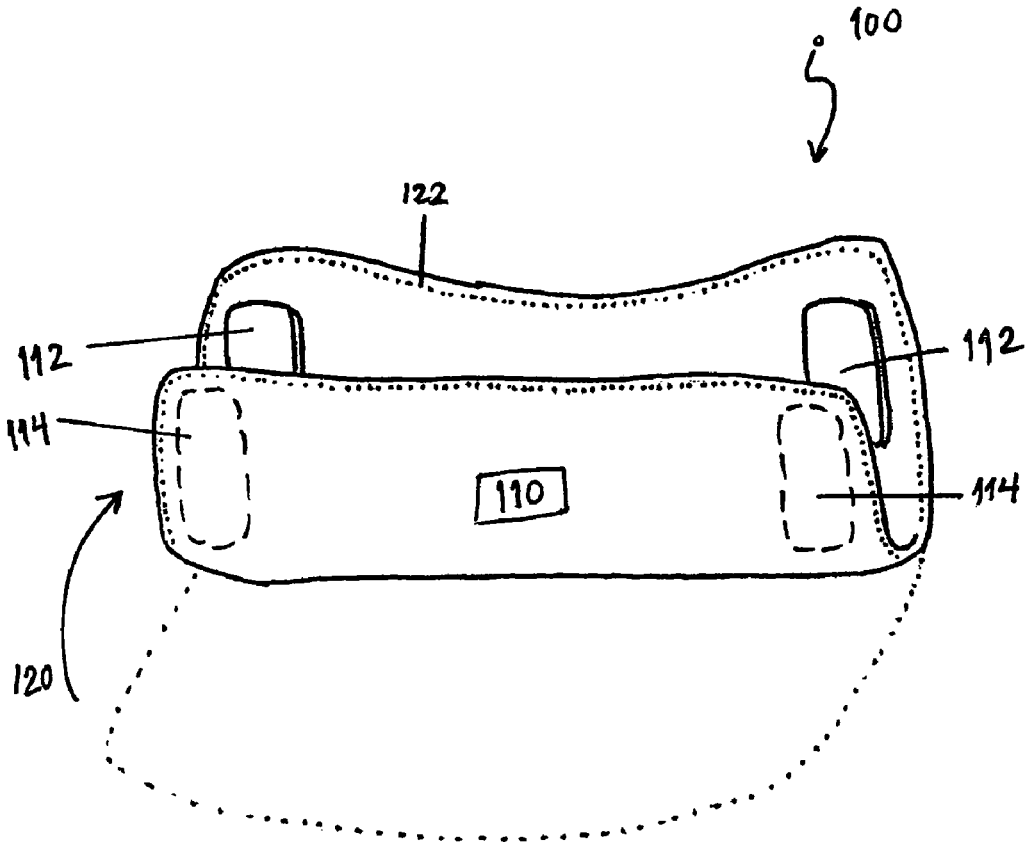
FIG. 1B illustrates an exemplary embodiment of a detachable protective cuff guard, folded for placement on the pants hem.

FIG. 1B illustrates an exemplary detachable protective cuff guard 100 folded in preparation for attachment to the hem of a pants leg. In an exemplary embodiment the detachable protective cuff guard 100 may be folded approximately in half in direction 120, bringing fastener elements 112 and 114 in sufficient proximity to engage. In one embodiment, the body 110 of the detachable protective cuff guard 100 is made of material sufficiently flexible that it may simply be bent in direction 120 to form the fold. In other embodiments, the body 110 of the detachable protective cuff guard 100 may be prepared with one or more creases along the approximate midline of the body 110 of the detachable protective cuff guard 100. Such pre-formed creases may serve to facilitate folding and positioning of the cuff guard 100. A position 116 for one such crease is illustrated in FIG. 1A.

Figure 2:
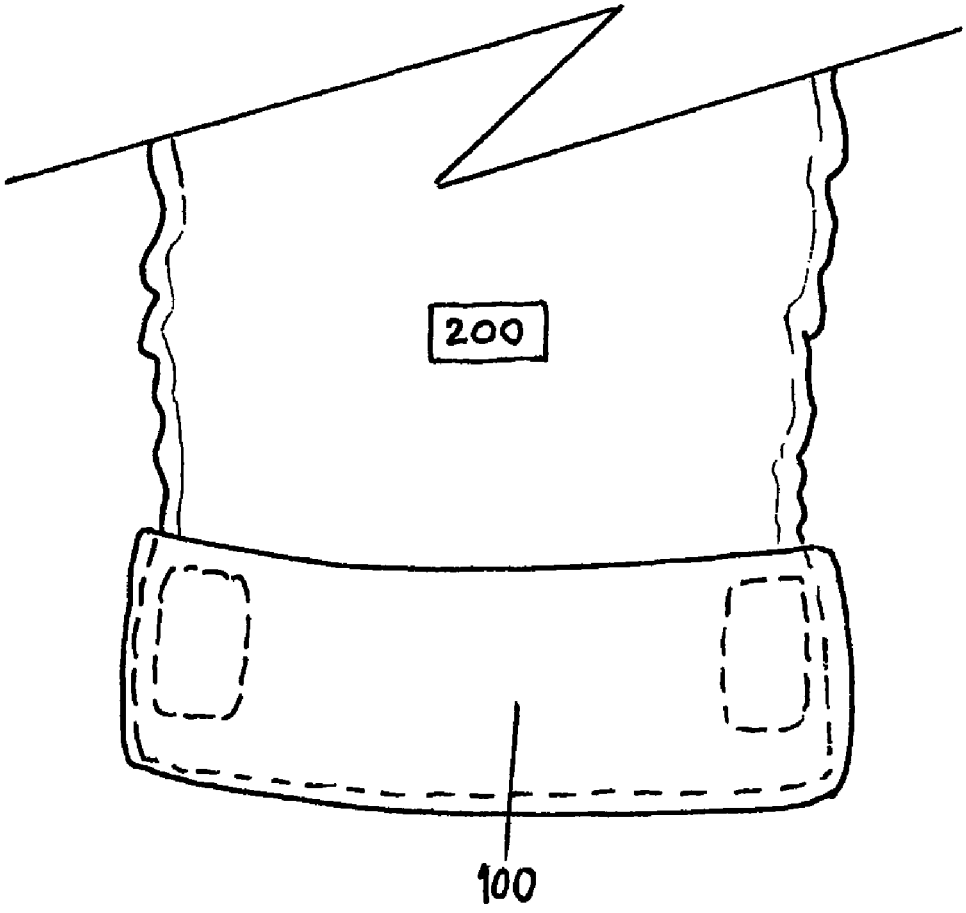
FIG. 2 illustrates an exemplary embodiment of a detachable protective cuff guard in place on the pants hem.
Figure 3:
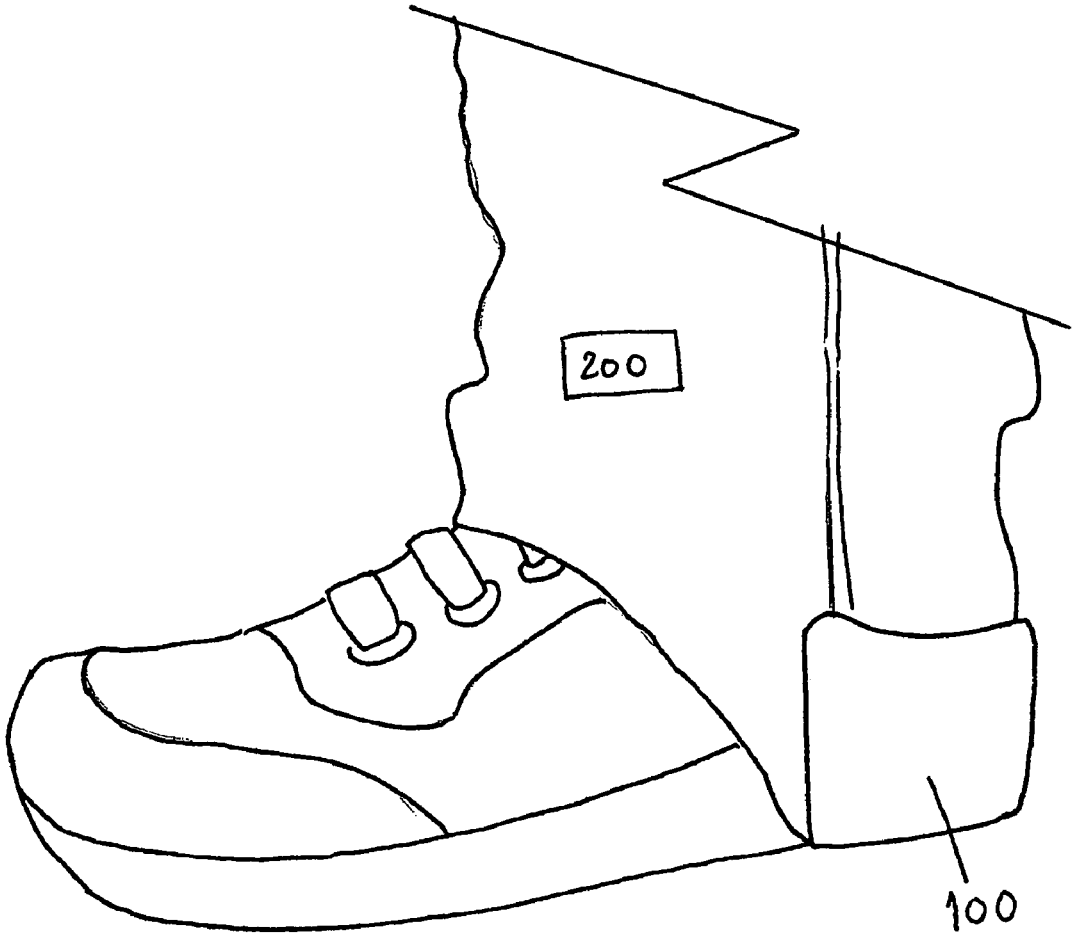
FIG. 3 illustrates an exemplary embodiment of a detachable protective cuff guard in place on the pants hem.

FIG. 2 illustrates an exemplary embodiment of a detachable protective cuff guard 100 in place at the hem of a pants leg 200. It should be understood that the durable material from which the body 110 of the detachable protective cuff guard 100 is made should be flexible enough that the cuff guard 100 may be bent to conform to the cylindrical contour of the pants leg. In one embodiment, the body 110 is long enough to cover the full circumference of the pants leg. In other embodiments, the body may cover only a portion of the pants leg. For example, in an embodiment adapted for use with casual pants worn long over the shoes, the body 110 may be long enough to cover only the rear half of the circumference of the pants leg 200. Such an embodiment is illustrated in FIG. 3, which shows a detachable protective cuff guard 100 wrapped around the rear of the hem of a pants leg 200. In other embodiments the body 110 may be long enough to cover approximately the portion of the front of the pants hem that is normally in contact with the top of the wearer's shoe.

The width of the detachable protective cuff guard 100, for example as measured from the bottom of pants leg 200 to the top of the cuff guard 100, may also be selected according to the needs and preferences of the intended users. The cuff guard 100 should preferably be wide enough to provide the desired protection, while narrow enough not to be unwieldy or unattractive, but a wide variety of both lengths and widths may be selected to suit the needs and desires of the intended users. In an exemplary embodiment for use by adults wearing casual pants with relatively broad hems, the cuff guard 100 is approximately 9.5 inches in length, and approximately 1.6 inches in width from the bottom of the pants leg 200 to the top edge of the cuff guard 100 when the cuff guard 100 is in place for use. Some embodiments designed for use with dress pants may be shorter in length but wider from the bottom of the pants leg 200 to the top edge of the cuff guard 100 in order to provide enhanced protection from mud and moisture in inclement weather. Still other embodiments may be formed in smaller sizes, e.g., for use by children.

The fastener elements 112 and 114 may be disposed in a variety of configurations. Any number of pairs of fastener elements may be employed. In the embodiments illustrated in FIGS. 1, 2, and 3, two pairs of fastener elements are employed, disposed near opposite edges of the body 110 of the detachable protective cuff guard 100 as shown. As few as a single pair of fastener elements, or three or more pairs of fastener elements may be employed, provided that the fastener elements are strong enough altogether to detachably secure the protective cuff guard 100 to the leg of the wearer's pants. In an exemplary embodiment, seven pairs of fastener elements are disposed, spaced approximately equally across the length of the protective cuff guard 100.

In addition, while the illustrated fastener elements are approximately rectangular in shape, any other shape or size may be employed, provided that the fastener elements are strong enough together to detachably secure the protective cuff guard 100 to the leg of the wearer's pants. In an exemplary embodiment, circular fastener elements are employed.

Figure 4:
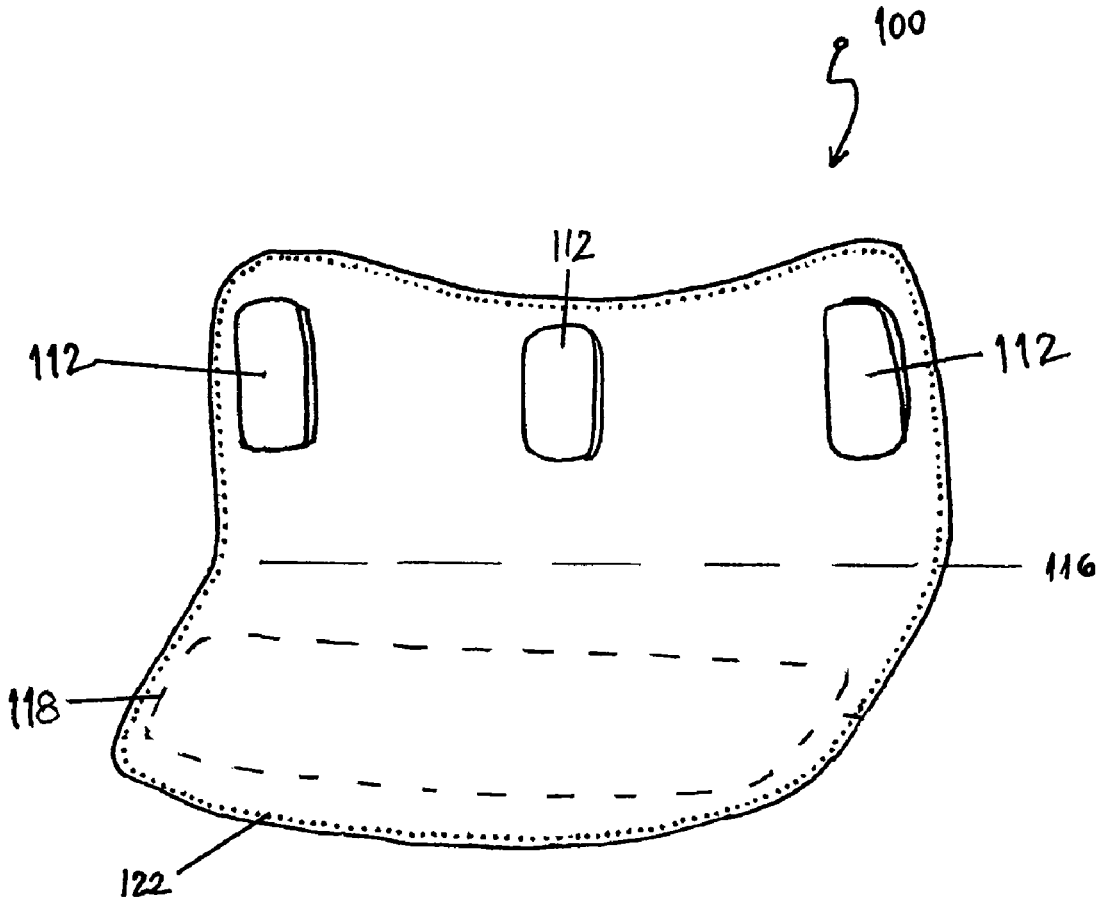
FIG. 4 illustrates an exemplary embodiment of a detachable protective cuff guard with an alternative fastener arrangement.

In an alternative embodiment illustrated in FIG. 4, rather than matched pairs of fastener elements 112 and 114, discrete fastener elements 112 engage a single, extended fastener element 118. In general, the fastener elements 112 and 114 may be disposed such that any number of fastener elements 112 engages any number of fastener elements 114 when the protective cuff guard 100 is folded as illustrated in FIG. 1B. Other configurations in which the fastener elements may engage magnetically through the pants leg to detachably secure the protective cuff guard 100 thereto will be recognized by those skilled in the art.

In some embodiments embodiment a decorative device such as the name and/or logo of a sports team, the name of the wearer, or any other similar decorative device may be painted, printed, or affixed to the body of the 110 of the detachable protective cuff guard 100, such that the decorative device is visible when the cuff guard 100 is in place on the pants leg 200.

Some embodiments may be configured to be reversible, such that different colors and/or decorative devices may be selected by the wearer by choosing the direction in which the detachable protective cuff guard 100 is folded and/or by choosing which face of the detachable protective cuff guard 100 is placed outward on the pants hem 200 when the cuff guard 100 is put in place for use. Referring again to FIG. 1A, in an exemplary embodiment, the body 110 of the cuff guard 100 may be formed of a durable material of a first color above an approximate midline 116 and a second color below the approximate midline 116. Such a two-color piece of protective material may be formed from two single-color pieces of durable material stitched, glued, welded, or otherwise bonded at the approximate midline 116. In still other embodiments, the body 110 may be formed by stitching or otherwise bonding one such two-color durable material with an additional piece of single-color durable material of a third color, or with an addition piece of two-color durable material having a third and a fourth color. Thus by choosing which side of the cuff guard 100 to fold inward, and by choosing the orientation of the folded cuff guard 100 in place on the pants leg 200, the user may choose which of up to four colors is displayed on the outer face of the cuff guard 100. Similarly, up to four decorative devices may be painted, printed, or otherwise affixed on the cuff guard 100, disposed so that the user may choose which one to display by folding and orienting the cuff guard 100 accordingly on the pants leg 200.

In an alternate embodiment, a protective cuff guard 100 made from durable material may be affixed to the wearer's pants leg by means of clips instead of or in addition to magnetic fasteners. Once the protective cuff guard has been folded as illustrated in FIG. 1B and positioned in place on the pants leg 200 as illustrated in FIG. 2, then one or more clips may be disposed to secure the cuff guard 100 in place on the pants leg 200. In an exemplary embodiment, clips made from metal or stiff plastic, such as spring clips, may be employed such that when a clip is disposed around the lower (folded) edge of the cuff guard 100, it supplies tension to secure the cuff guard 100 in place. Any number of clips sufficient to secure the cuff guard 100 may be disposed along the length of the cuff guard.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the scope of the invention. Accordingly, the foregoing description and drawings are by way of example only.

What is claimed is:

1. A garment for covering a bottom portion of a pants leg, the garment comprising:

a body having a first surface and a second surface, the body having an approximate midline which approximately bisects each of the first surface and the second surface;

a first magnetic fastener element and a second magnetic fastener element, each disposed between the first surface and the second surface; wherein the first magnetic fastener element and the second magnetic fastener element are disposed such that when the body is folded along the approximate midline and around the bottom portion of the pants leg, the first magnetic fastener element engages the second magnetic fastener element, detachably affixing the body to the pants leg and covering a portion of the pants leg; and wherein the first magnetic fastener element and the second magnetic fastener element are further disposed such that the body may be folded along the approximate midline and around the bottom portion of the pants leg either such that the first surface faces towards the pants leg and the second surface faces away from the pants leg, or such that the second surface faces towards the pants leg and the first surface faces away from the pants leg, allowing selection of which of the first surface and the second surface is displayed facing away from the pants leg.

2. The garment of claim 1, wherein the first surface and the second surface each include a different decorative device.

3. The garment of claim 2, wherein at least one of the first surface and the second surface comprises a fabric panel and wherein at least one of the decorative device of the first surface and the decorative device of the second surface comprises a printed design.

4. The garment of claim 1, further comprising one or more third magnetic fastener elements and one or more fourth magnetic fastener elements, each magnetic fastener element disposed between the first surface and the second surface, the one or more third magnetic fastener elements and the one or more fourth magnetic fastener elements disposed such that when the body is folded along the approximate midline and around the bottom portion of the pants leg, each of the one or more third magnetic fastener elements engages one of the fourth magnetic fastener elements, detachably affixing the body to the pants leg.

5. The garment of claim 1, wherein the first surface comprises a first portion and a second portion, the first portion disposed substantially to one side of the approximate midline and the second portion disposed substantially to the other side of the approximate midline, such that when the body is folded along the approximate midline and around the bottom portion of the pants leg such that the second surface faces toward the pants leg, the body may be oriented such that either the first portion or the second portion is displayed facing away from the pants leg.

6. The garment of claim 5, wherein the first portion and the second portion each include a different decorative device.

7. The garment of claim 6, wherein at least one of the first portion and the second portion comprises a fabric panel and wherein at least one of the decorative device of the first portion and the decorative device of the second portion comprises a printed design.

8. The garment of claim 5, further comprising one or more third magnetic fastener elements and one or more fourth magnetic fastener elements, each magnetic fastener element disposed between the first surface and the second surface, the one or more third magnetic fastener elements and the one or more fourth magnetic fastener elements disposed such that when the body is folded along the approximate midline and around the bottom portion of the pants leg, each of the one or more third magnetic fastener elements engages one of the fourth magnetic fastener elements, detachably affixing the body to the pants leg.

9. The garment of claim 5, wherein the second surface comprises a third portion and a fourth portion, the third portion disposed substantially to one side of the approximate midline and the fourth portion disposed substantially to the other side of the approximate midline, such that when the body is folded along the approximate midline and around the bottom portion of the pants leg such that the first surface faces toward the pants leg, the body may be oriented such that either the third portion or the fourth portion is displayed facing away from the pants leg.

10. The garment of claim 9, wherein the third portion and the fourth portion each include a different decorative device.

11. The garment of claim 10, wherein at least one of the third portion and the fourth portion comprises a fabric panel and wherein at least one of the decorative device of the first portion and the decorative device of the second portion comprises a printed design.

12. The garment of claim 9, further comprising one or more third magnetic fastener elements and one or more fourth magnetic fastener elements, each magnetic fastener element disposed between the first surface and the second surface, the one or more third magnetic fastener elements and the one or more fourth magnetic fastener elements disposed such that when the body is folded along the approximate midline and around the bottom of the pants leg, each of the one or more third magnetic fastener elements engages one of the fourth magnetic fastener elements, detachably affixing the body to the pants leg.

* * * * *